United States Patent [19]

Sowinski

[11] 4,436,204

[45] Mar. 13, 1984

[54] DRYWALL JOINT COMPOUND PACKAGING

[75] Inventor: Gerard T. Sowinski, Lancaster, N.Y.

[73] Assignee: National Gypsum Company, Dallas, Tex.

[21] Appl. No.: 448,291

[22] Filed: Dec. 9, 1982

[51] Int. Cl.[3] ..... B65D 75/48; B65D 77/12

[52] U.S. Cl. ..... 206/525; 53/467; 206/527; 206/820; 383/71; 383/78; 405/261

[58] Field of Search ..... 206/525, 527, 219, 820; 229/65; 405/261; 53/467; 383/71, 78

[56] References Cited

U.S. PATENT DOCUMENTS

| | | | |
|---|---|---|---|
| 2,257,823 | 10/1941 | Stokes | 206/820 |
| 2,781,900 | 2/1957 | Snyder et al. | 206/525 |
| 3,397,775 | 8/1968 | Seiferth et al. | 206/525 |
| 3,667,594 | 6/1972 | Herrell | 206/527 |
| 4,096,944 | 6/1978 | Simpson | 206/219 |
| 4,205,611 | 6/1980 | Slawinski | 206/525 |
| 4,372,708 | 2/1983 | Bower, Jr. et al. | 405/261 |

*Primary Examiner*—William T. Dixson, Jr.
*Attorney, Agent, or Firm*—Robert F. Hause

[57] ABSTRACT

A package of an aqueous slurry of drywall joint compound, which consists of a flexible cross-laminated, high density polyethylene film which, when formed into a tube, is the sole outer container and is substantially filled with the joint compound slurry.

10 Claims, 3 Drawing Figures

DRYWALL JOINT COMPOUND PACKAGING

The present invention relates to a package of ready-mix joint compound, and particularly to a joint compound slurry tubular container formed of a thin flexible cross-laminated high density polyethylene.

Drywall joint compounds are used in large quantities for concealing the joints between gypsum wallboards, in drywall construction. Although it can be obtained as a dry powder, for admixture with water before use, the great majority is sold in a ready-mix form, with water being admixed at the joint compound manufacturing facility.

These ready-mix joint compound slurries are normally packaged in a relatively rigid, five-gallon plastic pail. After the consumer is finished using the five gallons of ready-mix joint compound, the five-gallon plastic pail must be disposed of. Typical homes or living units being constructed with drywall will need about 10 to 20 five-gallon containers full of ready-mix, and will thus require disposal afterwards of 10 to 20 empty five-gallon pails.

In addition to the inconvenience of this disposal, there is the additional factor that these short-useful-life pails may cost the manufacturer as much as the cost of the joint compound contained in them.

A third factor to be considered is that there is always a layer of air in the pail above the joint compound, when full, and even more so if the contents of the pail are half used and then resealed with the lid. As a result, a certain amount of surface drying and hardening occurs, creating unusable material, and, still further, if the hardened material gets mixed into the remaining good material, degradation of the remaining material occurs, due to undesirable hard lumps throughout the slurry.

U.S. Pat. No. 3,747,744 discloses a conical-shaped plastic film package for a flowable roofing cement. This package is described as individually fabricated by heat-sealing two sides of the cone and the apex, filling the package through the base, and then the base is heat-sealed. This form of package is not adapted for high speed commercial fabrication which fills the package until taut.

The present invention provides a low cost, easily disposed of thin plastic tubular film container which conforms to the quantity of joint compound contained therewithin, excluding undesirable air from within the container, and maintaining the ready-mix slurry in good usable condition for as long as desirable, and for as many partial uses and reclosings as desired. In particular, the joint compound package of the present invention is automatically formed on equipment presently available, and used for packaging semi-viscous foods, such as ground meat spreads and cheese. An example of such machine is disclosed in U.S. Pat. No. 2,831,302 wherein a continuous web of plastic film is continuously passed over the end of and into a cylindrical device for converting the film into a continuous heat-sealed tube.

In accordance with the invention, joint compound is continuously fed into the tube as it is continuously formed, and immediately thereafter the continuous tube filled with joint compound is pressed at spaced positions therealong to void joint compound at that spaced position, whereat two clips are applied closely adjacent one another, and the continuous tube is severed therebetween, forming separate filled packages.

It is an object of the present invention to provide novel, improved packaging for ready-mix joint compounds.

It is a further object of the invention to provide substantial cost savings in the handling and use of joint compounds.

It is a still further object to provide an improvement relative to a potential environmental problem related to disposal of joint compound containers.

These and other objects and advantages of the invention will be more readily apparent when considered in relation to the preferred embodiments of the invention as set forth in the specification and shown in the drawings in which.

Figure 2:
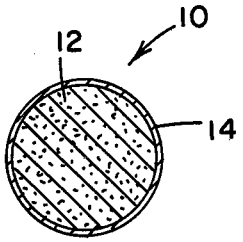
FIG. 2 is a sectional view of the package of FIG. 1, taken along line 2—2.
Figure 1:
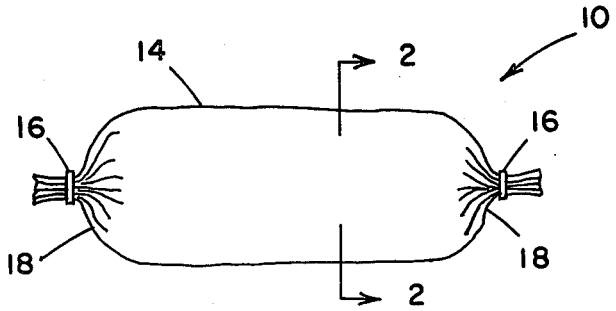
FIG. 1 is both a plan view and a front view of a package of ready-mix joint compound, embodying the present invention.

Referring to FIGS. 1 and 2, there is shown an elongate package 10 consisting of drywall joint compound ready-mix slurry 12 and a tubular flexible thin, impermeable, inert, plastic film container 14. Container 14 is gathered and sealed with mechanically crimped wire clips 16, 16 at each end 18, 18, or alternatively with short tie wires.

Container 14 is filled substantially full of ready-mix slurry 12 so as to exclude any voids or air pockets. A hollow open-ended container 14 is formed. The slurry 12 is placed in the container 14, and as the open end is closed substantially all air is removed from within the container. The newly closed end is then sealed to prevent either air or joint compound flow therethrough.

Container 14 is preferably formed of a cross-laminated, high density polyethylene film, such as a 3 mil thick Valeron film. Valeron is the trademark of Royal Packaging Industries, Van Leer Plastics B.V.

The 3 mil thickness film is satisfactory for a one-gallon package of ready-mix, weighing about 12½ pounds.

Figure 3:
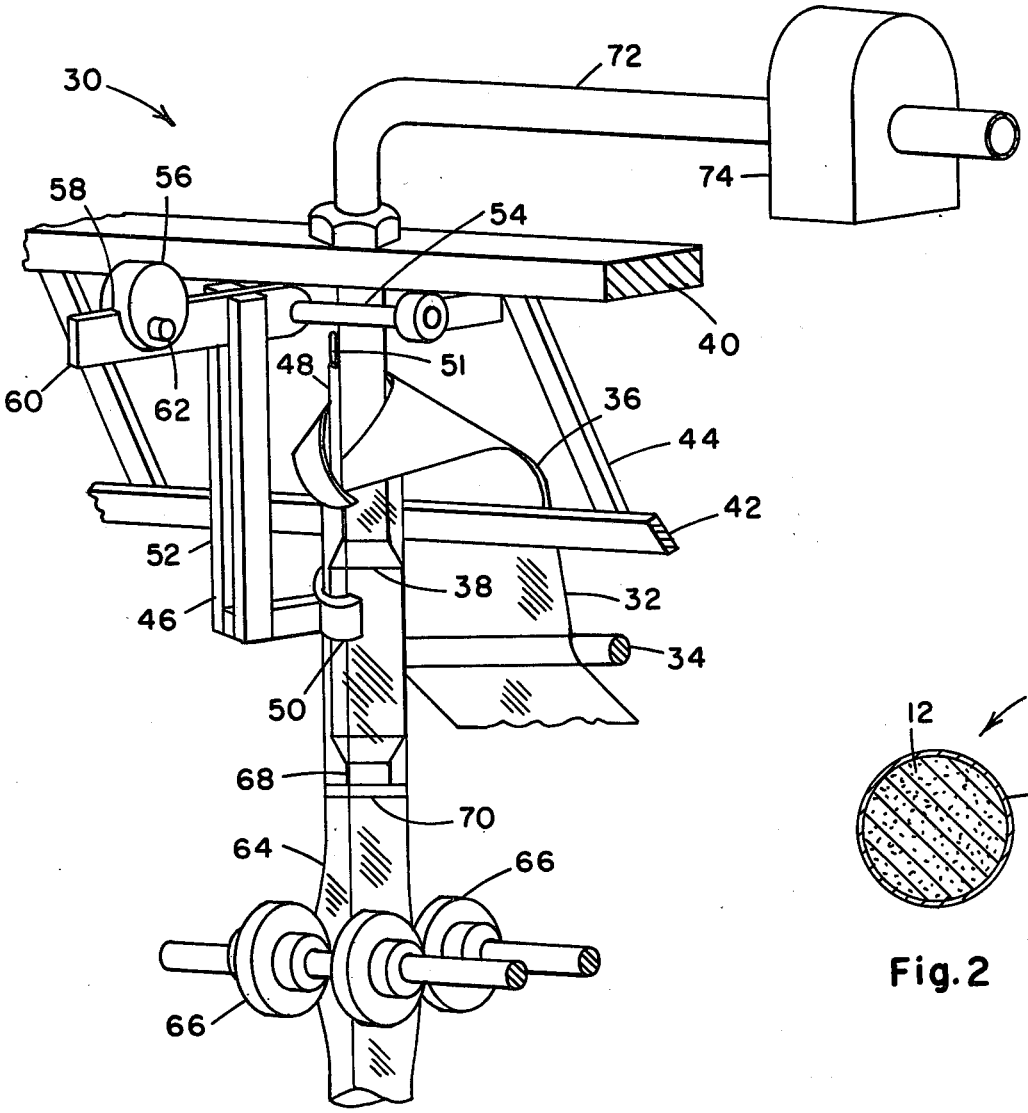
FIG. 3 is an isometric view of a portion of a machine of the type used to form a package as shown in FIG. 1.

Referring to FIG. 3, there is shown the package forming portion of a packaging machine 30, as more completely disclosed in U.S. Pat. No. 2,831,302, made a part hereof by reference, which machine can be used to form the package of FIGS. 1 and 2. FIG. 3 shows a continuous flat web 32 of cross-laminated, high density transparent polyethylene film which passes under a guide bar 34 which extends transversely of the machine 30.

From the guide bar 34 the web 32 passes upwardly and over a curved forming plate 36 and down around a tubular filling mandrel 38. The hollow mandrel 38 extends vertically through a top cross bar 40 forming part of the overall machine frame. The forming plate 36 is cut and shaped to form a collar around the mandrel 38 which reverses the direction of the web 32 and guides the edges thereof downwardly into overlapping tube forming relation around the mandrel 38. The forming plate 36 is secured on a cross bar 42 which is supported from the top cross bar 40 by hangers 44.

The web of material 32, guided by the plate 36 forms a continuous tube with overlapping edges which are continuously sealed by a sealing mechanism indicated at 46. When the package is formed of cross-laminated, high density polyethylene film the seam formed by the overlapping edges of the web is sealed by a mechanism 46 which comprises an electrically activated adhesive heating and dispensing element 48 and a pressure pad 50. The adhesive heating and dispensing element 48 is positioned to receive a continuous flexible rod 51 of solid, heat softenable polyethylene, heat this polyethylene forming a polyethylene hot melt adhesive, and dispense this hot melt adhesive between the two overlapped edges of the web of material 32. Pressure pad 50 is mounted on a depending angle arm 52 which is pivotally secured at 54 to the top cross bar 40.

The depending angle arm 52 is provided with a control weight 56 having a slot 58 for engaging over the attaching bar 60 which extends forwardly of the top part of the arm 52 and having an adjusting and securing screw 62 to provide as much pressure as desired between pressure pad 50 and the mandrel 38. The pressure provided by pressure pad 50 provides a continuous seal between the overlapping edges of the web 32 and forms the tube 64 which moves downwardly between cooperating pairs of feed rollers 66 disposed on opposite sides thereof immediately below the forming and filling mandrel 38.

The bottom end 68 of the filling mandrel 38 terminates at a ring 70 which is of sufficient diameter to frictionally engage the interior surfaces of the tube 64 and to form a barrier against upward pressure of the drywall joint compound ready-mix slurry 12 being packaged. The mandrel 38 is connected by a supply tube 72 with a pump 74 which continually supplies the slurry 12 from a suitable supply tank (not shown). The pump 74 is driven continuously during the filling operation and its speed may be adjusted by suitable adjustment means to control or vary the rate at which the slurry 12 is delivered from the bottom end 68 of mandrel 38 to the tube 64.

Suitable tube constricting or gathering and sealing means are disposed immediately below rollers 66, to form the tube 64 into a plurality of individual containers 14 with wire clips 16, 16 at each end 18, 18, by known means.

With container 14 filled as full as possible with ready-mix, the package 10 has a slight degree of rigidity. The package can be dropped without breaking; however, dropping may cause a slight amount of stretching of the container whereby some of the rigidity is lost.

A user can slit container 14 and squeeze out very easily substantially every bit of ready-mix contained therein. Alternatively, a user can form an opening in one end of container 14 and remove only a portion of the contents by squeezing out the amount desired, followed by sealing the container back up, without allowing any air to enter, using a paper-covered wire tie or the like.

Although a cross-laminated, high density polyethylene film is the preferred material for container 14, any other thin, flexible, impermeable film, inert when in contact with ready-mix, and of about 2 to 6 mils, can be used in accordance with the invention. A cross-laminated film, which provides more uniform strength characteristics, is clearly preferable.

Having completed a detailed disclosure of the preferred embodiments of my invention so that others may practice the same, I contemplate that variations may be made without departing from the essence of the invention.

I claim:

1. A package of ready-mix joint compound comprising a cylindrical plastic tube gathered and sealed at each end and filled with an aqueous slurry of drywall joint compound.

2. A package of ready-mix joint compound as defined in claim 1 wherein said plastic tube is a cross-laminated plastic film.

3. A package of ready-mix joint compound as defined in claim 2 wherein said plastic film is polyethylene.

4. A package of ready-mix joint compound as defined in claim 1 wherein said plastic tube has a thickness of about 2 to 6 mils.

5. A package of ready-mix joint compound as defined in claim 4 wherein said plastic tube is a cross-laminated polyethylene film.

6. The method of packaging an aqueous ready-mix joint compound slurry comprising the steps of continuously supplying a flat web of plastic film, continuously forming said flat web into tubular form with contacting edges, continuously sealing together said contacting edges, continuously supplying an aqueous slurry of drywall joint compound into the tube formed by said plastic film, and intermittently gathering a short section of said plastic tube and sealing said gathered portions to form the ends of two adjacent joint compound packages.

7. The method of claim 6 wherein said joint compound is supplied into said tube through a mandrel extending into said tube, said mandrel having a ring at the bottom end of sufficient diameter to frictionally engage the interior surfaces of said tube, and supplying said joint compound at a rate, relative to the rate of forming plastic tube, such that said joint compound is under enough pressure to produce some rigidity in the completed package.

8. The method of claim 7 wherein said plastic film is a cross-laminated plastic film.

9. The method of claim 8 wherein said plastic film is polyethylene.

10. The method of claim 9 wherein said plastic film is about 2 to 6 mils thickness.

* * * * *